US006213452B1

(12) United States Patent
Pettit et al.

(10) Patent No.: US 6,213,452 B1
(45) Date of Patent: Apr. 10, 2001

(54) RAILING SUPPORT POST

(75) Inventors: Frederick M. Pettit, Ridgeway; Michael E. Cook, Angus, both of (CA)

(73) Assignee: GSW Inc., Toronto (CA)

( * ) Notice: Subject to any disclaimer, the term of this patent is extended or adjusted under 35 U.S.C. 154(b) by 0 days.

(21) Appl. No.: 09/414,405

(22) Filed: Oct. 7, 1999

(30) Foreign Application Priority Data

Apr. 15, 1999 (CA) ..... 2269189

(51) Int. Cl.[7] ..... F04H 17/14; F16M 13/00; B25G 3/02

(52) U.S. Cl. ..... 256/59; 256/19; 256/65; 256/66; 248/519; 248/527; 248/188.8; 403/362

(58) Field of Search ..... 403/362; 256/59, 256/65, 19, 66; 248/519, 527, 188.8

(56) References Cited

U.S. PATENT DOCUMENTS 4,104,000 * 8/1978 Fleischmann ..... 256/65 X
4,448,003 * 5/1984 Hasbrouck ..... 403/362 X
5,143,472 * 9/1992 Reed et al. ..... 256/59 X
5,209,450 * 5/1993 Grapes ..... 248/527 X
5,312,089 * 5/1994 Venegas, Jr. ..... 256/65
5,695,174 * 12/1997 Tsai ..... 256/19 X
5,901,525 * 5/1999 Doeringer et al. ..... 248/519 X
6,141,928 * 11/2000 Platt ..... 256/65 X

FOREIGN PATENT DOCUMENTS

2364934 * 7/1975 (DE) ..... 248/527

* cited by examiner

*Primary Examiner*—Lynne H. Browne
*Assistant Examiner*—Ernesto Garcia

(57) ABSTRACT

A support post for a railing system comprises a base plate adapted to engage and support a vinyl support post at the base thereof and an interior support column located interior to the vinyl post. The support column is coupled to the base plate to form a high strength connection therewith. The upper end of the support column includes an arrangement for vertical adjustment of the vinyl support post.

10 Claims, 3 Drawing Sheets

RAILING SUPPORT POST

FIELD OF THE INVENTION

The present invention relates to railing systems, and in particular, to support posts easily secured to a generally horizontal support surface.

BACKGROUND OF THE INVENTION

There are a number of systems for vinyl railings including vinyl vertical posts secured to a support surface where the post engage the ends of handrails and bottom rails used to support spindles. With any handrail system, it is important that the system can withstand significant loads which are suddenly applied thereto when a person or persons fall against the rail and require the rail to oppose the load. This stability is largely provided by the vertical posts.

Vertical posts are typically anchored at the bottom thereof to the support surface to provide the required high strength connection. For example, the base of a post may include concrete anchors embedded in a horizontal concrete surface with a portion of these anchors extending upwardly into the base of the post and the base of the post being filled with concrete to secure the post to the support surface. In some systems, vinyl posts are applied over wooden support posts which are either anchored to the wooden deck themselves or embedded in concrete to provide the necessary strength.

There is a need to provide a railing system which can be strongly secured to a horizontal surface to provide the necessary structural stability but in a much simpler manner. It has been found that the typical do-it-yourselfer does not want to work with concrete and another arrangement for securing of the post to a horizontal surface is necessary. The present invention provides a mechanical securement of a post to a horizontal surface.

SUMMARY OF THE INVENTION

A support post for a railing system according to the present invention comprises a base plate, an interior support post and an exterior plastic tube. The base plate includes a horizontal plate with securement ports therethrough for attaching the horizontal plate to a support surface. The horizontal plate includes a series of upstanding flanges at the periphery of the plate positioned to snugly engage interior surfaces of the exterior plastic tube when the tube is sleeved over the flanges to fix the plastic tube to the base plate. The horizontal plate has, interior to the upstanding flanges, an upwardly extending rigid collar defining a support tube into which an end of the interior support post is inserted and secured. The fastening arrangement secures the end of the interior support post to the collar. The interior support post, at an end opposite the base plate, includes a series of adjustment screws spaced about the support post in engagement with the interior walls of the plastic tube. The screws are adjusted to orientate the tube in a generally vertical manner correcting for variations of the support post from vertical. The exterior plastic tube is oversized relative to the interior support post such that the exterior plastic tube conceals the interior support post therewithin.

According to an aspect of the invention, the exterior plastic tube is of a generally square cross section and the base plate has four upstanding flanges in engagement with the interior walls of the exterior plastic tube.

BRIEF DESCRIPTION OF THE DRAWINGS

Preferred embodiments of the invention are shown in the drawings, wherein.

DETAILED DESCRIPTION OF THE PREFERRED EMBODIMENTS

The support post 2 has a vinyl tube 4; in this case having a generally square cross section which forms the outer cover of the support post. An interior metal support 6 is attached to a base plate 8 which is secured to a horizontal support surface. The interior metal support engages an upper part of the vinyl tube and opposes horizontal movement of the vinyl tube.

Figure 1:
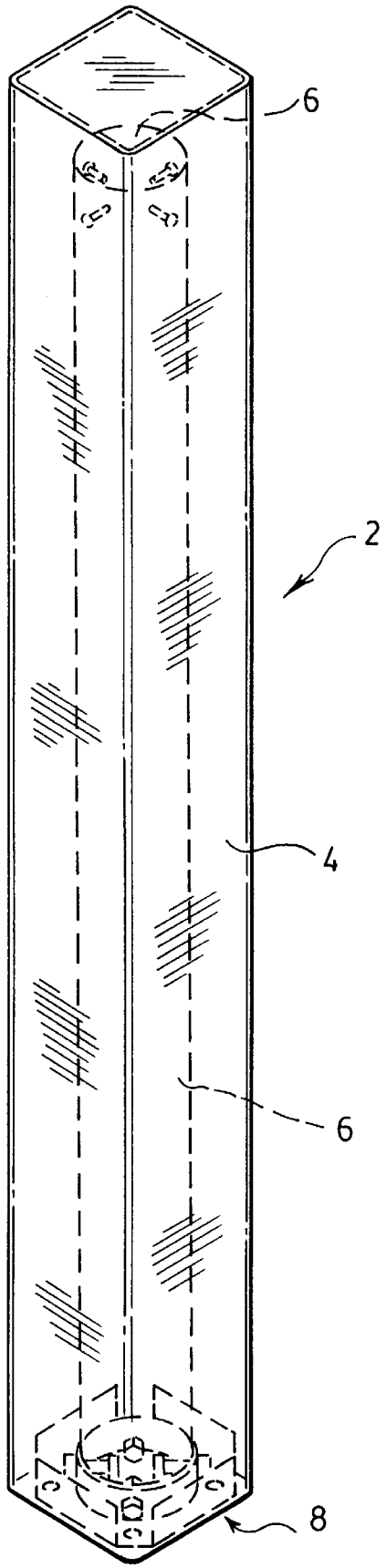
FIG. 1 is a perspective view showing a vinyl post with a support tube shown in phantom lines located interior to the post.
Figure 2:
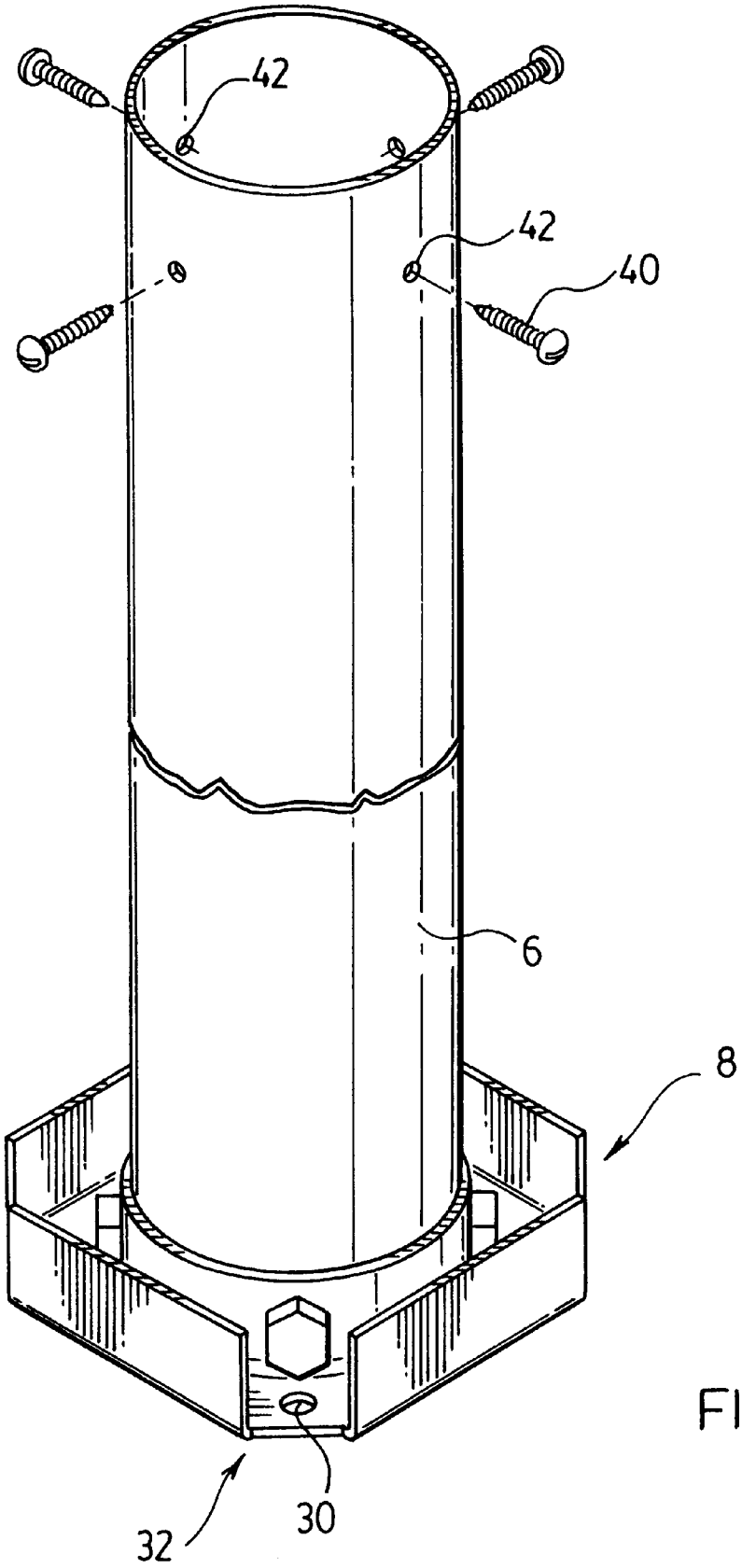
FIG. 2 is a partial perspective view showing a secured base and support tube.
Figure 3:
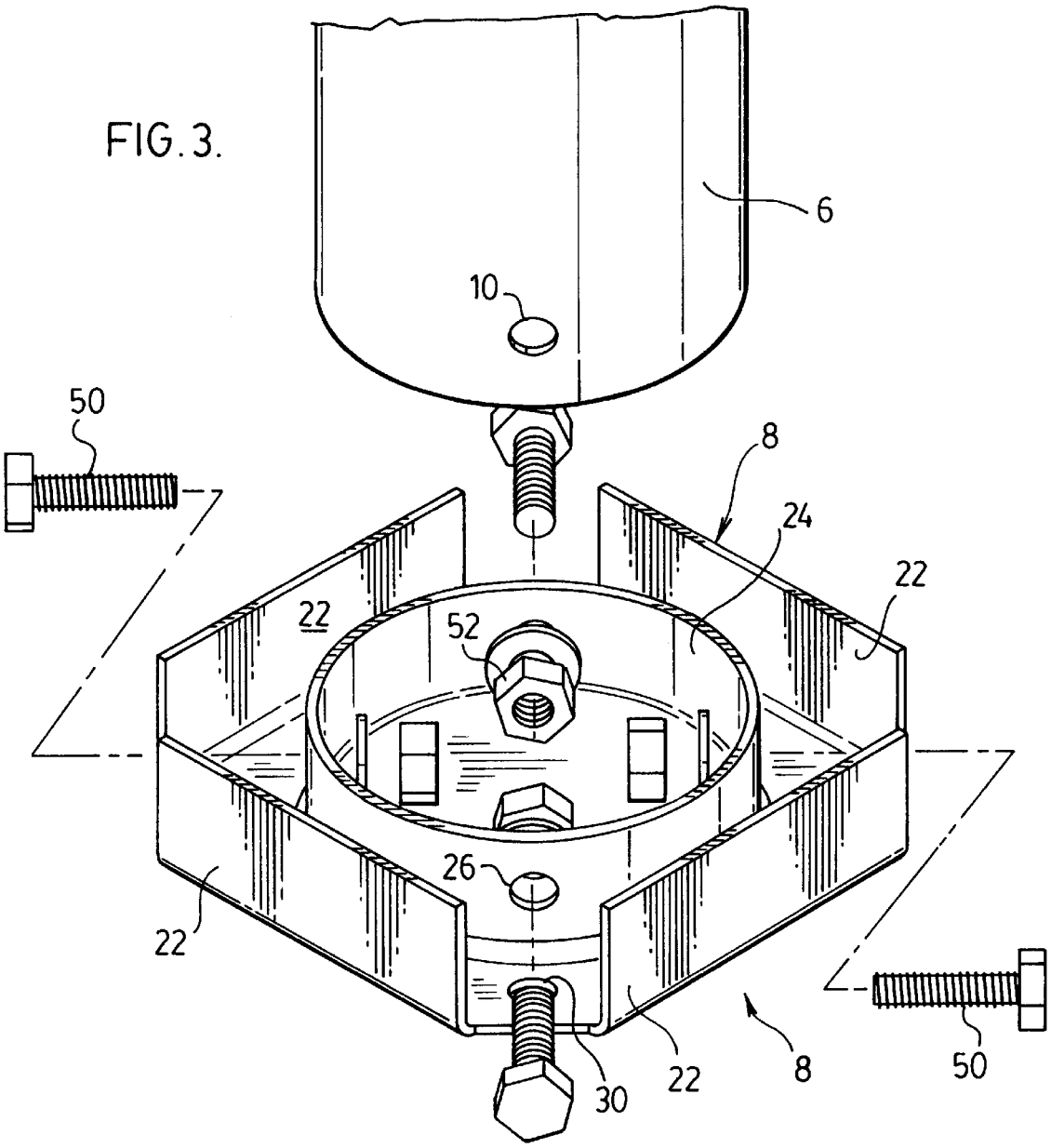
FIG. 3 shows additional details for securing of the support tube to the base.

FIGS. 2 and 3 show the base plate 8 which is attached to a horizontal surface by having mechanical fasteners pass through the ports 30 provided at the corners of the base plate 8. This provides a strong attachment of the base plate 8 to the horizontal surface. The base plate 8 includes a centering sleeve 24 extending upwardly and receiving within this sleeve the base of the metal support 6. The metal support 6 is preferrably a tube and is secured to the base plate 8 by a bolt and nut arrangement, preferrably at four spaced positions. The bolts pass through the ports 26 in the sleeve 24 and through ports 10 in the metal support 6. Nuts 52 are located interior to the metal support 6 and are accessible through the end of the tube. The base plate 8 includes upturned flanges 22 separated by open corners 32 which simplify installation of the bolts. The upturned flanges 22 provide reference edges which engage the interior faces of the vinyl tube 4 and provides a snug fit or slight interference fit therewith.

Preferrably, the user secures the base plate 8 to the horizontal support surface with the metal support 6 already secured to the base plate 8. If the support surface is generally horizontal, the interior metal support 6 will be generally vertical. In most cases, the support surface and the base plate are not horizontal and as such the metal support 6 will not be vertical. The standoff screws 40 are secured within ports 42 of the support 6 and are adjusted to provide the desired support and vertical orientation of the vinyl tube 4. Shimming of the base plate is only necessary for extreme variations.

With the base plate fastened securely to the mounting surface, a plumb or level is used to adjust the screws at the top of the post until it is plumb with the outside flange 22. This step is repeated on a side 90° from the first side. The end of the vinyl post is then placed over the end of the support and the remaining two adjustments screws 40 are adjusted to fit inside the vinyl post. Any mechanical connectors used to connect a handrail or bottom rail to the vinyl posture are attached. The vinyl tube is then applied over the interior metal support 6 and the upturned flanges 22 are forced into the interior of the vinyl tube 4. Thus, the base of the vinyl tube 4 is effectively located on the support surface. The vinyl tube 4 is secured to the upturned flanges 22 using self taping metal screws that penetrate both the tube and the upturned flanges.

It has been found that this arrangement provides a strong mechanical securement of the vinyl tube 4 to a generally horizontal support surface. If the support surface is wood, the securement of the base plate 8 is simple and straightforward. If the horizontal surface is concrete, the base plate can be appropriately placed on the concrete, the locations of the holes for securing of the base plate to the concrete can be marked, and the concrete can be drilled and plugged for securing of the base plate 8 to the concrete. The user does not need to mix concrete or effectively attach reinforcing bars to existing concrete. The system also has the advantage that the base plate is secured in a simple manner and final adjustment of the vinyl tube is provided at the upper end of the support tube. Basically, the interior support has various adjustments for providing a vertical orientation of the vinyl tube even though the support post may be at an angle to vertical.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A support post for a railing system comprising a base plate, an interior support post and an exterior plastic tube; said base plate including a horizontal plate with securement ports therethrough for attaching said horizontal plate to a support surface, said horizontal plate including a series of upstanding flanges at the periphery of said horizontal plate positioned to snugly engage interior surfaces of said exterior plastic tube when said tube is sleeved over said flanges to fix said plastic tube to said base plate, said horizontal plate including interior to said upstanding flanges an upwardly extending rigid collar defining a support tube into which an end of said interior support post is connected, and a mechanical fastening arrangement securing said end of said interior support post to said collar; said interior support post at an end opposite said base plate including a series of adjustment screws spaced about said support post in engagement with the interior walls of said plastic tube with said screws adjusted to orientate said tube in a generally vertical manner correcting for variations of said support post from vertical; and wherein said exterior plastic tube is oversized relative to said interior support post such that said exterior plastic tube conceals said interior support post therewithin.

2. A support post as claimed in claim 1 wherein said exterior plastic tube is of a generally square cross section and said base plate has four upstanding flanges in engagement with the interior walls of said exterior plastic tube.

3. A support post as claimed in claim 2 wherein said base plate is a rigid structure.

4. A support post as claimed in claim 1 including lug screws for securement thereof.

5. A support post for a railing system comprising a base member, an interior support post and an exterior plastic tube; said base member including securement ports for attaching said base member to a support surface, said base member including a shoulder arrangement at the periphery thereof positioned to snugly engage interior surfaces of said exterior plastic tube when said tube is sleeved over said shoulder arrangement to fix said plastic tube to said base plate, said base member including interior to said shoulder arrangement an upwardly extending support structure which cooperates with and secures an end of said interior support post to extend generally perpendicular to said base member, and a mechanical fastening arrangement securing said end of said interior support post to said support structure; said interior support post at an end opposite said base member including a series of adjustment screws spaced about said support post in engagement with the interior walls of said exterior plastic tube with said screws adjusted to orientate said tube in a generally vertical manner and wherein said exterior plastic tube conceals said interior support post therewithin.

6. A support post as claimed in claim 5 wherein said support structure is a collar centered relative to said base member and said interior support post is mechanically secured to said collar.

7. A support post as claimed in claim 6 wherein said series of adjustment screws include four screws equally spaced about said interior support post.

8. A support post as claimed in claim 7 wherein said interior support post is a metal tube.

9. A method of securing a vinyl support post to a generally horizontal surface comprising the steps of mechanically attaching a base member to the horizontal surface, mounting an interior support post to said base member to extend in a generally perpendicular manner relative to said base member and said horizontal surface, adjusting two offset screws adjacent a free end of said interior support post to be respectively located in a vertical plane associated with one of two reference edges of said base member where said reference edges are disposed in a perpendicular manner, locating two additional screws on said interior support post to be perpendicular to each other and opposite one of said two offset screws, adjusting said two additional screws such that said offset screws and said two additional screws engage and snuggly receive said vinyl support post which is sleeved over said interior support post and sleeved over said base member to accurately locate said vinyl support post in a vertical manner with the base plate fixing one end of said vinyl support post and said adjusting screws maintaining the position of an opposite end of said vinyl support post whereby said exterior plastic tube is supported by such base member and said interior support post located interior to said vinyl support post.

10. A method as claimed in claim 9 including securing a cap member to an open top of said vinyl support post.

* * * * *